United States Patent [19]

Friess

[11] 4,402,399

[45] Sep. 6, 1983

[54] SYSTEM FOR THE STORAGE OF COINS AND THE LIKE

[76] Inventor: Wolfgang Friess, Lunckenbeinstrasse 22, 8800 Ansbach, Fed. Rep. of Germany

[21] Appl. No.: 317,815

[22] Filed: Nov. 3, 1981

[30] Foreign Application Priority Data

Nov. 4, 1980 [DE] Fed. Rep. of Germany ..... 3041530

[51] Int. Cl.³ ..... A45C 11/28; A47B 81/00

[52] U.S. Cl. ..... 206/0.83; 206/0.84; 206/45.34

[58] Field of Search ..... 206/0.83, 0.84, 0.82, 206/0.8, 45.34

[56] References Cited

U.S. PATENT DOCUMENTS

| | | | |
|---|---|---|---|
| 632,938 | 9/1899 | Greenburg | 206/0.82 |
| 2,258,535 | 10/1941 | Buranelli | 229/92.9 |
| 3,028,949 | 4/1962 | Sohosky | 206/0.83 |
| 3,069,001 | 12/1962 | Burdick | 206/0.83 |
| 3,249,392 | 5/1966 | Berman | 206/0.83 |
| 3,554,625 | 1/1971 | Sly, Sr. | 206/0.83 |
| 3,788,464 | 1/1974 | Skinner | 206/0.82 |
| 3,837,475 | 9/1974 | Bolanz | 206/0.8 |

*Primary Examiner*—William T. Dixson, Jr.

*Attorney, Agent, or Firm*—Jordan and Hamburg

[57] ABSTRACT

An arrangement for storing and displaying coins and the like includes a rigid mounting device having one or more openings for receiving a coin, the coin being mounted in the opening such that both sides of the coin may be viewed, the mounting means having coin-engaging portions which are made of a material which does not adversely affect the coin.

7 Claims, 15 Drawing Figures

SYSTEM FOR THE STORAGE OF COINS AND THE LIKE

BACKGROUND OF THE INVENTION

The present invention relates to an arrangement for the safekeeping, storage and examination of coins and medals and has as a purpose to provide a storage possibility that is superior to known traditional arrangements.

It parts from the known arrangement wherein coins in private or other collections have up to now been kept and exhibited in depositories which in most cases have rigid divisions which excludes the individual combination of different objects. In such known arrangements, the coins are often insufficiently protected against outside effects. Moreover, the depositories for safekeeping and even exhibition often do not allow the observer to look at the coin surfaces from all sides. In addition, the known depositories, in view of their construction, cannot be sufficiently adjusted for different coin sizes and, even if they should have some of such desirable features, their manufacturing costs are excessively high as compared to their intended use.

Thus, it has, among other things, been known to store coins in boxes which either have predetermined rigid divisions or individual depositories for coins, wherein such boxes have individual, portable depositories or are parts of larger storage arrangements such as chests, trunks, cabinets, cupboards or the like, showing to the observer only one face of the coins stored therein.

Also some coin depositories such as cassettes have the same drawback of one-sided visibility. Their special features consists in that they have a deformable, multicolored base, into which any desired number of coins may be inserted by pressure of the finger which results in a lasting depression that provides secure stable support to the inserted coin.

To make the coin visible from all sides, it has already been attempted to store them individually in boxes or tins of various forms of a transparent material that have, as an opening, a drawout cover as well as inserts with grooves of a predetermined diameter for securing the coin and several inlays to compensate for different sizes of coins. These depositories as well as, for example, coin boxes of a hard plastic, are intended for certain sets of coins, which are kept in them and arranged in cardboard or hard plastic frames, where the individual diameters required for each purpose have been exactly provided so that they may be used only for that particular set of coins. For this reason, they are sold in commerce as so-called exchange coin cases.

In contradistinction thereto, coin albums with suspendable pockets or pouches allow for a more individual arrangement since their area is subdivided into pockets for individual coins. However, such sheeted pockets are suitable only for the storage of coins in a horizontal position because their sturdiness in relation to the inserted coins is minimal. It has been ascertained that evidently some components of these sheets react with the metal of the coins which fact is evidenced by a change in appearance of the surface of the coins that are kept in such sheeted pouches.

There has also been known a supporting frame of artificial material for individual coins which consists of two spring-activated or tightly interconnectable cover plates, each comprising a recess with a conical inner edge or border surface. This form of recess is provided with the object to make visible the toothed or otherwise decorated border of the coin, which, however, is only possible in coins whose diameters are substantially smaller than the width of the recess in the covering plates. Moreover, because of the viewing angle, it per force will only be possible to obtain a distorted image of the edge or border formation of the coin.

In order to protect the coin surface against touching, clear sheets are inserted on the covering plates which have press-through holes for the pins required to connect the frame halves and basically have the already-mentioned disadvantage that they cause a change in the coin surface.

Another disadvantage of such frames or little boxes for individual coins is that, for rational reasons, they are available or offered in a predetermined outer size, differing solely in the size of the receiving openings for the coins. Such an arrangement thus is unsatisfactory for the reason that in view of the fixed outer size, storage of small coins takes as much space as large-sized coins.

There has already been known an arrangement for the storage of coins in which these are stored individually in special supports which, in turn, are inserted in the recesses of a carrier body. The recesses of such support bodies may have a conical edge, but its angle of inclination is so small that the coins are not held securely in place, which is especially the case when the arrangement, taken out of its horizontal position, is stood up or is turned around for observation of the reverse side of the coins. In this known arrangement, cohesion among the individual coin holders and their carrying plate is achieved by the fact that the adjoining or neighboring surface borders of both parts and provided with protrusions and corresponding counter-recesses which together result in an elastic mounting support.

Finally, the prior art also discloses a support frame for rectangular and square coins which is provided with punch-outs or blankings to correspond to the form of the coins in which the coin is gripped or clampingly held. However, this requires the observance of strict measurements for the traversing openings. The manufacture of such frames, therefore, results in an expensive proposition. These frames, moreover, are wholly inadequate in arrangements where the coins are often changed. For these cases, a development in the aforementioned frame has been described whose essential feature consists in that the press-in openings are provided with supporting and contacting areas in the form of a collar or an encircling supportive border or edge to prevent fall-out or press-through of the coin. In order to protect the inserted coins against touching, it has been proposed to slide the coin-carrying frames into pouches or bags with clear jackets which, again, in view of the natural duration or time of safekeeping, with the passage of time, results in undesired discolorings of the coin surface.

Accordingly, it is an object of the present invention to overcome the disadvantages of these known prior art arrangements and to provide a mounting support for coins which meets all practical requirements and is especially suited for coins that heretofore could not be adequately stored, such as those with an irregular surface border or that have arched surfaces.

According to the present invention, this objective is achieved by an encircling, rigid mounting support which allows coins to be observed from all sides without touching, which mounting, at least in the surfaces touching the coins, consists of a substance that does not affect the coin surface being preferably of a plasticizer-free synthetic material such as acrylic glass and having at least one recess for tight coin mountings. Methyl methacrylate polymers such as Plexiglas and Lucite are other examples.

By using the arrangement of the present invention, each individual coin is securely stored against mechanical damage and chemical effects while being visible from all sides in a transparent holder. The arrangement is simple and inexpensive to manufacture even in single units for collectors and amateurs, allowing further for individual compositions to hold coins in different shapes and sizes by which especially irregularly-shaped coins can be securely stored. This arrangement may be assembled into individual elements or also in special combinations and may be observed, transported, and exhibited as decoration as well as exhibited objects in the house or other locations.

In a further embodiment of the present invention, it is provided that the coin mounting has at least one carrying body formed as one single part with at least one recess for coins, the recesses on both sides having locking covering plates and affixation elements for securing of the carrying body and covering plates. This locked coin mounting ensures that the appearance, especially of the coin itself, remains unchanged even when the coin depository is frequently held in the hand, being observable anytime, instead of being locked inside drawers and chests. In the spirit of the present invention, further improvement of the coin mounting has been achieved by providing covering plates of a transparent material with heat-treated or hardened surfaces, preferably of a scratch-resistant acrylic glass, and that the surfaces of the carrier body for the coins have a dull finish which excluses undesirable mirror effects, while the coin itself, especially where collection pieces with bright surfaces are involved, delineates itself from its background and thus its viewing is enhanced.

In order to provide a support for coins differing within a certain range of diameters without the need to provide exact recesses in the coin holder, it has been found to be of advantage, according to one embodiment of the invention, to provide the carrier body with at least one conical recess of preferably 20° inclination and whose cross-section on one front side of the carrier body is smaller than the diameter of the coin.

For coins where also the lower border has to lie free, it is convenient to form the recess serving to hold the coin as a radial bore in the carrier body in the area of both frontal faces.

A convenient embodiment of the arrangement according to this invention for irregularly-formed coins comprises a carrier body having two plates, and the recess for the coins is formed by openings of which, in each case, two are coaxially arranged, widening conically from the frontal faces toward their contacting face, wherein the carrying body consists of at least two plates disposed over each other and, possibly, in addition, a carrying plate with a radial opening sandwiched inbetween.

Depending on the form of the coins to be held, it might be convenient to form the recess for coin support of two conical recesses of different diameters coaxially arranged in the carrier body or to form the carrier body of three plates whose intermediate plate has at least one radial opening to receive the coins and whose outer border is covered by the border of the conical openings with the smaller diameter in the neighboring outer carrier plates.

For coins that should be kept especially free from pressure and tension, the recesses in the carrier body may be provided along their circumferential border with protrusions to hold the coins.

Independent from a special mounting for the coins, the carrier body and covering plates may be kept together by screw elements, while the border of the carrier and covering plates lying over each other are encircled by a frame that preferably consists of two parts wherein, preferably, at least one of the covering plates is arranged in slidable fashion in the frame, and supporting means are provided to prevent unintended opening of the coin mounting.

A further embodiment of the present invention provides for several carrier bodies between covering plates mounted in the frame with at least one recess for receiving the coins, wherein the total surface of the carrier bodies corresponds to the outside dimension of the covering plates, and the coin pallet consisting of the carrier body, covering plates and frame is provided with auxiliary means for standing up or suspending the arrangement.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

DESCRIPTION OF THE PREFERRED EMBODIMENTS

Figure 1:
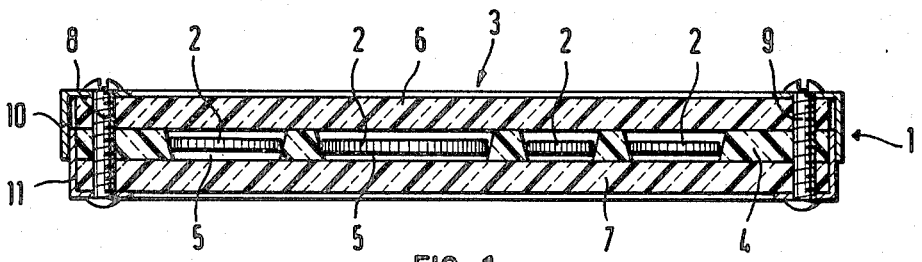
FIG. 1 is a cross-sectional view of a complete coin pallet according to one embodiment of the invention.

Referring to the drawings, FIG. 1 shows a basic arrangement of a coin pallet 1 according to one embodiment of the present invention, wherein several coins 2 are disposed in their rigid mounting which basically consists of a coin carrier body 4 formed as one part with recesses 5 for the coins 2, cover elements 6, 7, affixation elements 8, 9, and a frame 10, 11 formed in two parts. The parts 4, 5, 6 forming mounting 3 and which might touch the coins are of a transparent, plasticizer-free synthetic material which has no substances that might react with the substances of the coins, acrylic glass being regarded as an example of an especially suitable material.

Figure 2:
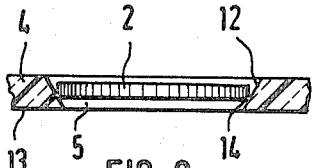
FIGS. 2 to 7 are partial cross-sectional views of special mountings for different coin types.

In order to keep the touching surfaces between the coins 2 and their jacket at a minimum, but especially to secure the coins in a horizontal position with only small deviations within a certain tolerance limit, the recesses 5 in the carrier body 4 may have the form of conical openings 12 (FIG. 2). By way of example, an inclination angle of 20°, for the walls of these openings 12 has been found to be appropriate for holding coins, especially relatively old pieces that were not made with the present-day precision and exactitude in dimensions of modern stamping machines, but were made manually or with the help of simple tools and machines, their form and dimension for this reason never being consistently the same. If an inclination angle of less than 20° is selected for recesses 5, then an especially exact finish is necessary because the tolerance for the opening dimension will thereby be reduced. An inclination angle larger than 20° may present a problem with relatively thin coins because, with an increased angle opening, the contact area between the coins and carrier body will always be smaller. The one-sided secure hold which at the same time does not exert any substantial pressure on the coins is especially important in cases where the coin mounting is not to be arranged horizontally in a lying-down position but rather where it is to be stood up vertically or suspended.

The holding of coins in conical openings, moreover, has the advantage that it is simple and inexpensive to form different coin arrangements to suit the taste of individual collectors and amateurs, since the recesses 5 may be manufactured with the same tools in a simple manner and coins 2 with varying diameters may be securely fixed by a simple pressure of the finger so that the coins will not fall out even upon turning or revolving the carrier body or the whole coin pallet.

Manufacture of the carrier body 4 provided with recesses 5 may be effected in a way so that initially there is formed or cut a carrier plate with the desired outer dimensions, the coins being then laid over it, the centers or middle points of the openings being marked and thereafter, the openings provided. It is noted that the diameter of the opening on one frontal face 13 should be smaller than the coin diameter. This ensures that the coins will not fall out nor touch one of the covering plates 6, 7. For this reason, also the thickness of the carrier body 4 is dimensioned so that it is greater than the maximum thickness of the coins 2 to be held by it. The carrier body may also be provided with the desired recesses by casting or spraying with the aid of forms or molds. Furthermore, should it be necessary, the carrier body may be slightly heated just before arranging the coins in order to improve secure holding conditions still further.

Figure 3:
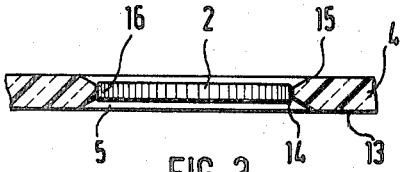

While in the embodiment of FIG. 2 the frontal side 13 of the carrier body 4 extends radially inwardly of the lower border 14 of the coin 2, this is not so in the embodiment according to FIG. 3. In FIG. 3, recess 5 is tapered on both frontal sides 13 and 15 of the carrier body so that the coin edge 14 lies exposed on both sides. In order to provide a wider holding surface, the middle part of the recess 5 may be provided with a radial bore 16 of some constant axial length in which coin 2 will sit tightly as shown in FIG. 3.

Figure 4:
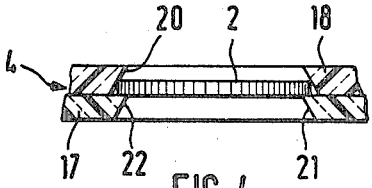

Contrary to the carrier bodies 4 formed in one piece represented in FIGS. 2 and 3, for certain types of coins it may be convenient to use a carrier body that is formed of two or several plates 17, 18, 19 diposed on top of each other. In the embodiment shown in FIG. 4, the plates 17 and 18 of the carrier body 4 have conical recesses 20, 21, each having variable diameters so that the coin 2 is held not only by the conical border of recess 20 but, in addition, is supported by the protruding edge 22 of recess 21.

Figure 5:
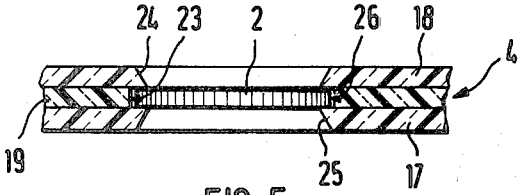

For especially pressure-sensitive coins, such as the hollow German Pfennige, the coin mounting shown in FIG. 5 offers an advantage.

In FIG. 5, the carrier body 4 consists of three plates 17, 18, 19, wherein the middle plate is provided with a radial bore 23 that has a larger diameter than the conical recess 24, 25 in the adjoining outer carrier plates 17, 18. The edges of the recesses 24, 25 extend radially inwardly of the outer diameter 26 of coin 2 which, with a corresponding dimensioning of the recess 23, is encircled in a pressure-free manner.

Figure 6:
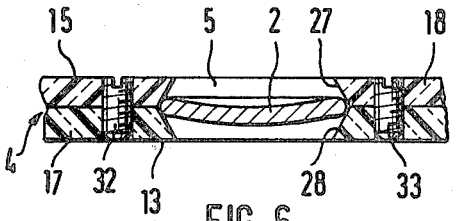
Figure 7:
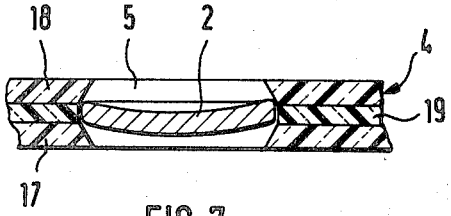

Coin carriers with an arrangement as represented in FIGS. 6 and 7 are especially suitable as mountings for fragile or breakable articles, for instance, irregularly-formed coins that have been produced by roll stamping. In FIG. 6, the carrier body consists of two plates 17 and 18 each with a conical opening 27, 28, whose diameter at the outer faces 13, 15 of the carrier body 4 is larger than the diameter where the two plates 17, 18 contact one another (FIG. 6), while the embodiment according to FIG. 7 has, in addition, a middle carrier plate 19 having an opening for receiving the coin.

Figure 8:
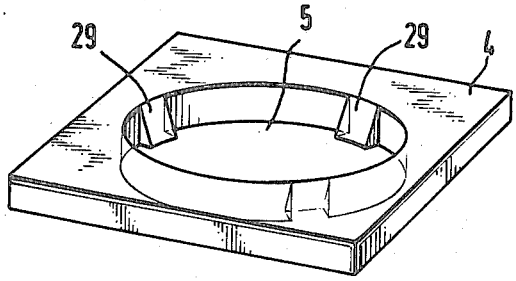
FIGS. 8 and 9 are each a perspective view of a mounting for an individual coin.
Figure 9:
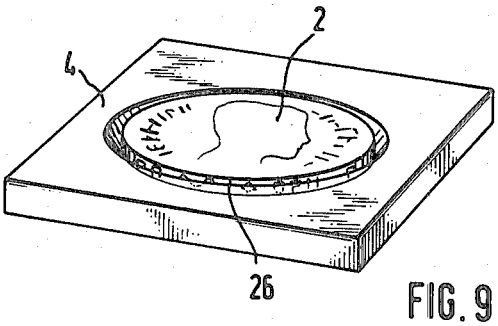

FIG. 8 shows another embodiment of the coin mounting according to the present invention which has the feature that part of the material of the conical recess in carrier body 4 has been reduced in such a way that the contact surfaces for the coins 2 consist of support protrusions 29.

The conical configuration of recesses 5 for coins 2 serves not only to keep them in a certain position but also has the advantage that the outer border 26 of the mounted coin is easily visible which is of special interest in cases where the border area is provided with an inscription or some sort of decoration or ornamentation. Without the edges and the side areas of the conical recess, there remains an unhindered, clear view of the outer border and edge of the coin.

Figure 10:
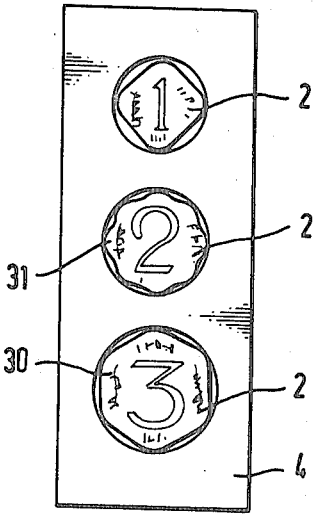
FIG. 10 is a top view of an arrangement for an irregularly-shaped coin.

The coin mounting of the present invention is also advantageous for use with non-round coins, for example, a coin having a square configuration, a coin 31 having a wavy-formed edge, or a coin 30 having six sides all as shown in the top view of FIG. 10.

As already mentioned, independently from the form of the recesses 5 for the coins 2, if a carrier body 4 of multiple parts is provided, such carrier body 4 may be covered on both sides by plates 6, 7 which may be made of a transparent material such as non-colored glass and mechanically non-sensitive, especially scratch-resistant, in order that the appearance of the surface may remain in perfect and flawless condition. A further improvement in appearance of the arrangement may be obtained if the carrier body is formed traversable or the surface is slightly colored or dulled so that the coins may contrast or be set off relative to their background, which in known coin cases may be achieved by providing a background of different textile materials wherein, however, only the upper side of the mounted coins may be examined at any one time. Apart from the esthetic effect, dulling has mainly the purpose of avoiding undesirable reflection or mirror effects.

As can be seen in FIGS. 1 to 6, the various parts of the coin mounting 3 may be held together by affixation elements of various types, such as, for example, set screws or headless screws 32, 33 (FIG. 6) which connect parts 17 and 18 of the carrier body, as well as, in lieu of such set screws or additionally provided screw elements 8, 9 (FIG. 1) which, besides the carrier body that may consist of multiple parts, also traverses the covering plates 6, 7 and, to the extent this may be required, also serve to affix the frames 10, 11 which extend over the edge or border of the arrangement.

Figure 11:
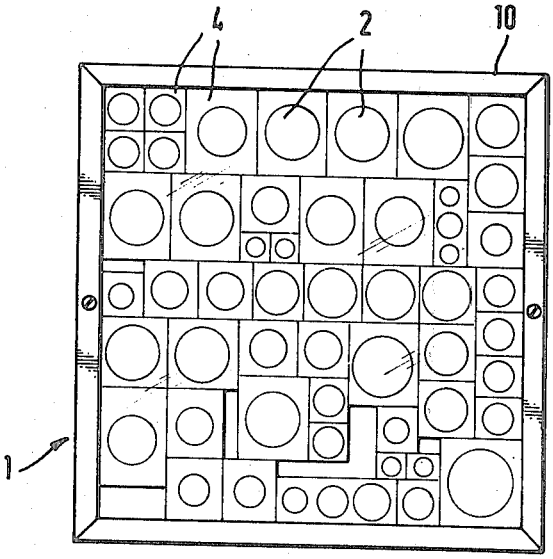
FIG. 11 is a top view of a pallet for a set of different coins.

Such frames are used when it is desired to produce not only a carrier body for one or several coins as shown in FIG. 1, but a whole pallet as, for instance, shown in FIG. 11. In such a pallet, several carrier bodies are assembled next to each other between the frontal sides of the covering plates which encompass one or several coins of various forms and sizes, allowing, furthermore, for individual selection and arrangements of coins according to any desired time or thematic viewpoints. The total surface of all carrier bodies of a pallet may correspond to the surface measurement of the covering plates. In given cases the remaining intermediate spaces (such as the lower left corner of FIG. 11) may be filled with carrier plate sections without coin recesses. The freedom of choosing the size of these pallets and the carrier bodies to arrange therein one or several coins is of special advantage to the collector since here, in contradistinction to traditional coin depositories, he can decide on his own what type of arrangement he wants to store his coins and which intermediate spaces he wishes to select, etc., such that he can store his coins in a manner as he sees fit without having to compromise with preformed or prefabricated storage arrangements.

To the extent that coin pallets constitute a closed arrangement or for other reasons when they may hardly be expected to be opened, all parts may be arranged to form a compact unit with the use of screw elements or other affixation means that traverse frames 10, 11. If, however, the coins are to be easily accessible, or exchangeable, then the coin pallet may be set up so that one of its covering plates 6, 7 is formed as a sliding cover which can be slid out to one frame side. However, screws, pins or lugs may be provided to hold the arrangement secure in place during normal storage or transport to prevent unintended opening.

Figure 12:
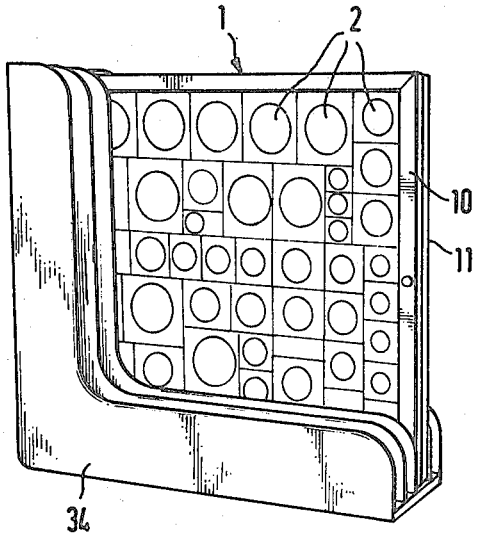
FIG. 12 is a perspective view of a pallet mounting arrangement.
Figure 13:
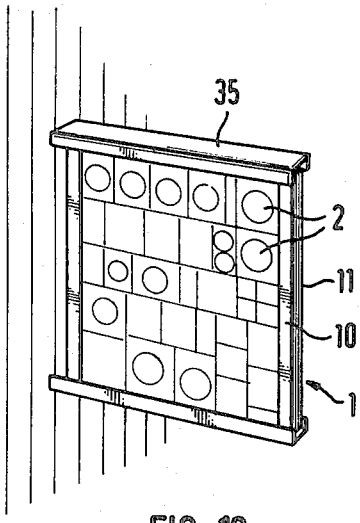
FIG. 13 is a perspective view of a coin pallet hanging on a wall.
Figure 14:
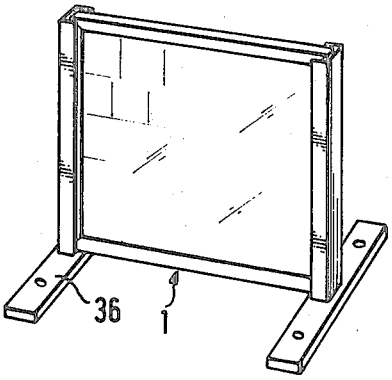
FIGS. 14 and 15 are perspective views of different pallet mounting arrangements.
Figure 15:
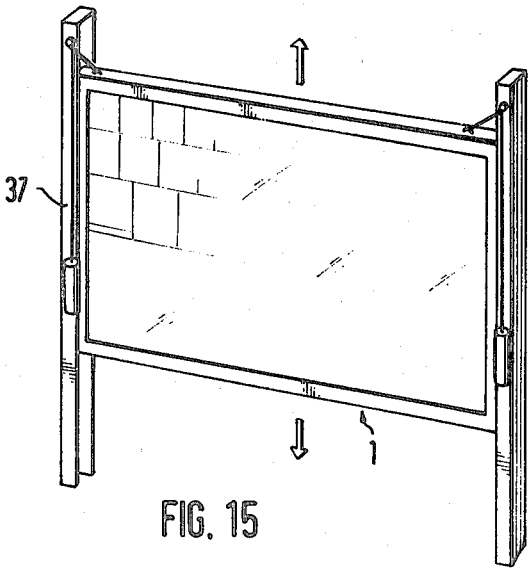

As shown in FIGS. 12 to 15 , coin pallets 1 constructed according to the present invention distinguish themselves over traditional arrangements especially in that they do not need to be slid in in a conventional manner to lie in slip-cases, boxes, chests or the like, but rather, depending on the selection, they may be hung up or suspended or stood up by themselves, for example, in shop windows or the like. FIG. 12 shows an arrangement possibility for several pallets in a stand or rack 34 similar to a record stand, while FIG. 13 shows a coin pallet mounted to extend away from the wall, fastened by means of affixation elements that are not shown and which grip into the suspension frame 35. In principle, a coin pallet 1 could also be hung parallel to the wall, as for instance with the aid of an especially constructed exchange frame. FIG. 14 illustrates a pallet affixation in a holder or support 36 that can be set up on tables or consoles, while FIG. 15 illustrates a stand or rack 37 that is especially advantageous for use in exhibitions where the suspended coin pallets can be displaced at a high level with the aid of weights.

It lies, of course, within the scope of the present invention, whose principles have been explained by the above-described embodiments, to supplement the invention by still other not herein mentioned elements, such as identification, designation, or characteristic explanations or indicia of the individual objects or coins.

What I claim is:

1. A device for storing and displaying coins comprising a carrier body having at least one coin opening for receiving a coin to be displayed, said carrier body being made of a transparent material to thereby enable viewing of the entire coin disposed in said coin opening, transparent covers disposed on both sides of said carrier body, fastening means fastening said covers and said carrier body together to thereby form a rigid structure enclosing said coin, said carrier body having a thickness greater than the coin disposed in said coin opening such that the coin disposed in said coin opening is located in an intermediate position spaced from said covers, said coin opening having a first annular portion which has a diameter less than the largest dimension of said coin, said coin opening having another annular portion having a diameter greater than the largest dimension of said coin such that said first annular portion tightly engages said coin to retain the latter in said coin opening and said other annular portion is spaced from said coin facilitating access of said coin to said coin opening, said carrier body being made of a plasticizer-free synthetic material which does not react with said coin, whereby the coin is tightly retained in said coin opening without reacting chemically with said carrier body while being viewable from all sides.

2. A device according to claim 1 wherein said carrier body has two parallel planar surfaces, said coin opening being defined by a conical wall with the smallest diameter of said conical wall being disposed in one of said planar surfaces and the largest diameter of said conical wall being disposed in the other of said planar surfaces, said smallest diameter of said conical wall being smaller than the diameter of said coin, said larger diameter of said conical wall being larger than the diameter of said coin, said coin engaging said conical wall at a position intermediate said two planar smaller surfaces.

3. A device according to claim 2, wherein said conical wall is defined by a conical surface, said conical surface sloping at about 20 degrees relative to the axis of said conical surface.

4. A device according to claim 1, wherein said coin opening comprises beveled edges extending from both outer faces such that the walls of said coin opening tapers radially inwardly from both outer faces with the smallest diameter of said coin opening being disposed at an intermediate axial portion of said coin opening, said intermediate axial portion engaging and supporting said coin.

5. A device according to claim 1, wherein said carrier body comprises at least two superimposed carrier plates, said coin opening being defined by two conical walls coaxially disposed with one conical wall being in one of said carrier plates and the other conical wall being in the other of said carrier plates, said one conical wall having its smallest diameter outwardly disposed, said other conical wall having its largest diameter outwardly disposed such that the largest diameter of said conical wall and the smallest diameter of said other conical wall are disposed in the interfacial plane of said two superimposed carrier plates, the smallest diameter of said one and said other conical walls being smaller than the diameter of said coin, the largest diameter of said one and said other conical walls being larger than the diameter of said coin, said coin being disposed in the enclosure defined by said one conical wall with one face of said coin being disposed in the interfacial plane of said two superimposed carrier plates, said coin being retained in said coin opening by engagement with said one conical wall and being supported by said other carrier plate on the interfacial surface of said other carrier plate bordering the smaller diameter of said other conical wall.

6. A device for storing and displaying coins comprising a carrier body having at least one coin opening for receiving a coin to be displayed, said carrier body being made of a transparent material to thereby enable viewing of the entire coin disposed in said coin opening, transparent covers disposed on both sides of said carrier body, fastening means fastening said covers and said carrier body together to thereby form a rigid structure enclosing said coin, said carrier body having a thickness greater than the coin disposed in said coin opening such that the coin disposed in said coin opening is disposed in an intermediate position spaced from said covers, said carrier body comprising an intermediate carrier plate disposed between two outer carrier plates, said intermediate carrier plate having an intermediate opening in which said coin is disposed, said intermediate opening having a diameter greater than the largest diameter of said coin, each of said outer carrier plates having conical openings defined by conical walls which have their smallest diameter on the face thereof closest to said intermediate plate, said smallest diameter of said conical walls in said two outer plates being less than the largest diameter of said coin, whereby said coin is retained in said intermediate opening by the interfacial surfaces of said two carrier plates bordering the smallest diameter of the conical opening in each of said two carrier plates, said carrier body being made of a plasticizer-like synthetic material which does not react with said coin, whereby the coin is retained in said coin opening without reacting chemically with said carrier body while being viewable from all sides.

7. A device for storing and displaying coins comprising a carrier body having at least one coin opening for receiving a coin to be displayed, said carrier body being made of a transparent material to thereby enable viewing of the entire coin disposed in said coin opening, transparent covers disposed on both sides of said carrier body, fastening means fastening said covers and said carrier body together to thereby form a rigid structure enclosing said coin, said carrier body having a thickness greater than the coin disposed in said coin opening such that the coin disposed in said coin opening is disposed in an intermediate position spaced from said covers, said coin opening having an intermediate annular portion which has a diameter less than the largest dimension of said coin to thereby retain said coin in said intermediate opening, said coin opening having two outer annular portions having a diameter less than the diameter of said intermediate annular portion, said carrier body being made of a plasticizer-free synthetic material which does not react with said coin, whereby the coin is retained in said coin opening without reacting chemically with said carrier body while being viewable from all sides.

* * * * *